US007473373B1

(12) United States Patent
Danler

(10) Patent No.: US 7,473,373 B1
(45) Date of Patent: Jan. 6, 2009

(54) STORMWATER POLLUTION MANAGEMENT APPARATUS AND METHOD OF USING SAME

(76) Inventor: Perry W. Danler, 5506 George St., Richmond, IL (US) 60071

( * ) Notice: Subject to any disclaimer, the term of this patent is extended or adjusted under 35 U.S.C. 154(b) by 0 days.

(21) Appl. No.: 11/901,433

(22) Filed: Sep. 17, 2007

(51) Int. Cl.
*E03F 5/14* (2006.01)

(52) U.S. Cl. ..... 210/747; 210/800; 210/162; 210/170.03; 210/489; 210/532.1; 405/41; 405/43; 405/127

(58) Field of Classification Search ..... 210/747, 210/776, 800, 162, 170.03, 170.09, 170.11, 210/308, 489, 497.01, 532.1; 405/36, 41, 405/43, 45, 127
See application file for complete search history.

(56) References Cited

U.S. PATENT DOCUMENTS

| | | | | |
|---|---|---|---|---|
| 1,083,148 | A * | 12/1913 | Sparks | 405/36 |
| 1,456,759 | A * | 5/1923 | Booth | 210/170.09 |
| 2,052,020 | A * | 8/1936 | Black | 405/41 |
| 3,460,675 | A * | 8/1969 | Hicks et al. | 210/747 |
| 4,919,568 | A * | 4/1990 | Hurley | 405/43 |
| 5,052,855 | A * | 10/1991 | Chapman et al. | 405/36 |
| 5,113,889 | A * | 5/1992 | McGuire, Jr. | 405/127 |
| 5,536,420 | A | 7/1996 | Oyzboyd | |
| 5,725,760 | A | 3/1998 | Monteith | |
| 5,820,751 | A | 10/1998 | Faircloth, Jr. | |
| 6,077,423 | A * | 6/2000 | Roy et al. | 210/170.03 |
| 6,241,877 | B1 * | 6/2001 | Berkey | 210/170.09 |
| 6,277,274 | B1 * | 8/2001 | Coffman | 210/170.03 |
| 6,461,078 | B1 * | 10/2002 | Presby | 210/170.08 |
| 6,609,852 | B2 | 8/2003 | Wimberger | |
| 6,783,683 | B2 | 8/2004 | Collings | |
| 6,926,464 | B1 | 8/2005 | Weidmann | |
| 7,025,076 | B2 | 4/2006 | Zimmerman, Jr. et al. | |
| 7,029,201 | B1 | 4/2006 | McCormick et al. | |
| 7,052,207 | B1 | 5/2006 | Wimberger | |
| 2002/0090267 | A1 | 7/2002 | Wimberger | |
| 2004/0173523 | A1 * | 9/2004 | Beaulieu | 210/747 |
| 2006/0275083 | A1 | 12/2006 | Wimberger | |

* cited by examiner

*Primary Examiner*—Christopher Upton
(74) *Attorney, Agent, or Firm*—Law Office of John W. Harbst

(57) ABSTRACT

A stormwater pollution management apparatus for a stormwater basin including a water intake assembly having a first end and a second end generally aligned along an axis and includes a hollow inverted T-shaped connector. A horizontal intake projects in a first direction from one side of the T-shaped connector toward the first end of the water intake assembly. The axially elongated intake defines a series of openings along the length and about the periphery thereof. An outlet projects in a second direction from a second side of the T-shaped connector toward the second end of the water intake assembly. A wrapper extends along and about the generally horizontal intake for creating an energy differential between the sediment water flowing into the water intake assembly and the water in the basin thereby affecting separation of particulate sediment from the water flowing into the water intake assembly. A hollow riser extends upwardly from the connector. A terminal end of the riser extends a predetermined distance below an emergency overflow level of the basin. Moreover, the hollow riser defines a passage for viewing water quality flowing toward the second end of the water intake assembly. A method for managing stormwater pollution drainage from a stormwater basin into a storm drain is also disclosed.

20 Claims, 5 Drawing Sheets

STORMWATER POLLUTION MANAGEMENT APPARATUS AND METHOD OF USING SAME

FIELD OF THE DISCLOSURE

The present disclosure generally relates to stormwater management and, more particularly, to a stormwater pollution management apparatus arranged in a stormwater basin for treating stormwater runoff through gravitational separation of the sediments therein and a method of using such apparatus.

BACKGROUND OF THE DISCLOSURE

When the ground is exposed by the removal of natural vegetation or other protective ground cover, it is subject to erosion by wind, rain, and flowing water. The sediment loss is usually such that it is absorbed without significant damage. Erosion and sediment loss, however, of land wherein new construction is occurring, i.e., roads, housing developments, and/or commercial development can be significantly greater than the rate from farmland or forests. Sediment resulting from uncontrolled erosion is a form of water pollution that can damage downstream properties and streams. Sediment pollution also tends to fill storm drain pipes, streams, and rivers thus increasing the potential for flooding. Such sediment tends to fill water supply reservoirs and/or detection basins and reduces useful storage capacity of such basins.

With the introduction of the Clean Water Act, the importance of water quality and the impact of construction on natural streams and watercourses was recognized. Since then, federal, state and local regulations and ordinances have been enacted to insure the impact of new home construction on water quality was minimized. As a result, inlet protection, channel liners, vegetation, seeding and sodding, silt fences and sediment/detention ponds all became associated with construction activity. Most new construction projects or developments are now required to incorporate some level of erosion and sediment control during construction. Today, therefore, it is common practice to incorporate a variety of erosion and sediment control devices and techniques in connection with construction projects.

During construction, sediment control is used where water runoff is concentrated in a stormwater basin comprised of an impoundment below the land disturbance with a drain or sewer pipe leading therefrom. At the beginning of a rainfall event, the basin can be empty. The basin fills, either partially or completely, depending on the amount of rainfall and the volume of resulting runoff, as sediment laden runoff enters. Much of the suspended soil particles in the sediment laden runoff settle to the bottom of the basin. When the stormwater basin fills, sediment water flows into the sewer pipe and flows offsite downstream through sewers.

To control the flow of stormwater into the sewer pipe, a temporary water outlet is usually provided for each stormwater basin. A typical water outlet for a stormwater basin includes a generally L-shaped perforated tube structure. One perforated leg section of such tube structure extends from and is temporarily connected to the sewer pipe or drain. Another perforated leg section of such a known tubular outlet acts as a vertical riser or standpipe. The outlet is intended to meter the flow of water from the stormwater basin so as to cause the basin to fill, thus creating a desired pool of water. As the water sits in the basin, some of the soil particles in the water settle to the bottom of the basin.

The perforations in each leg of the outlet extend about a periphery of each tubular leg section. Those perforations in the lower portion of the outlet drain water from a lower portion of the stormwater basin where the sediment has been deposited. As a result, often times a considerable amount of sediment is drained through the outlet and introduced into the inlet end of the sewer drain causing damage downstream from the stormwater basin. Typically, the size of the outlet and the number or size of the openings in the leg sections of the outlet are neither designed nor constructed in accordance with the size of the particular stormwater basin with which the outlet is to be utilized. These known imprecisely sized outlets can create significant problems during the construction phase of the development. First, they are not sized relative to the size of the stormwater basin they are designed to operate in combination with. Second, and over time, they fail to operate in an efficient and effective manner. Moreover, such known outlets fail to control pollution of the water being directed therethrough. Upon completion of construction, and because the sediment water flow in the basin has substantially halted, the outlet is usually removed from the sewer pipe.

Thus, there is a continuing need and desire for a stormwater pollution management apparatus and method for draining water from a stormwater basin while controlling sediment pollution downstream of the inlet to the sewer pipe or drain from such basin.

SUMMARY OF THE DISCLOSURE

According to one aspect, there is provided a stormwater pollution management apparatus adapted to be arranged in operable combination with a storm sewer pipe of a stormwater basin. The stormwater pollution management apparatus includes a sediment water intake assembly adapted to be supported proximately at an upper surface of water in the basin. The water intake assembly has a first end and a second end generally aligned along an axis and includes a hollow inverted T-shaped connector. An axially elongated and generally horizontal intake projects in a first direction from one side of the T-shaped connector and toward the first end of the water intake assembly. The axially elongated intake defines a series of openings along the length and about the periphery thereof for allowing water to pass into and be guided by the intake toward the second end of the water intake assembly. A generally horizontal outlet projects in a second direction from a second side of the T-shaped connector and toward the second end of the water intake assembly for directing water toward an inlet to the storm sewer pipe. A wrapper is operably joined to and extends along and about the generally horizontal intake for creating an energy differential between the sediment water flowing into the water intake assembly and the water in the stormwater basin thereby affecting separation of particulate sediment from the water flowing into the water intake assembly. A hollow riser extends upwardly from the connector and generally normal to the axis extending between the first and second ends of the water intake assembly. A terminal end of the riser extends a predetermined distance below an emergency overflow level of the stormwater basin. Moreover, the hollow riser defines a passage for viewing water quality flowing toward the second end of the water intake assembly.

In a preferred form, the connector, the intake, and the outlet of the water intake assembly are each formed from plastic. In one form, the length of the intake is determined by the overall size of the stormwater basin wherein the stormwater pollution management apparatus is to be used. Preferably, the size of the openings defined by the intake is determined by the overall size of the stormwater basin wherein the pollution management apparatus is to be used.

Preferably, the wrapper for the stormwater pollution management apparatus extends along and about the generally horizontal intake and includes a wire screen mesh operably coupled to the intake by a series of bands. In a most preferred form, the wrapper extending along and about the generally horizontal intake includes a wire screen mesh arranged in layered relation relative to a fabric screen, with the wire mesh and fabric screen being operably coupled to the intake by a series of bands. Preferably, the wrapper extending along and about said generally horizontal intake has a modular configuration and is replaceable.

The hollow riser of the stormwater pollution management apparatus preferably has an open top end and defines a series of openings along the length and about the periphery thereof for allowing water to pass into and be guided by the riser and the outlet toward the second end of the water intake assembly. In a preferred form, the hollow riser further includes a wrapper operably joined to and extending along and thereabout for creating an energy differential between the sediment water flowing into the riser and the water in the basin thereby affecting separation of particulate sediment from the water flowing into the riser.

According to another aspect, there is provided a stormwater pollution management apparatus adapted to be arranged in operable combination with a storm sewer pipe. The stormwater pollution management apparatus includes a sediment water intake assembly adapted to be supported proximately at an upper surface of water in a stormwater basin. The sediment water intake assembly has a closed first end and a second open end generally aligned along an axis and includes a hollow inverted T-shaped connector. An axially elongated and generally cylindrical intake is connected to and horizontally projects away from the T-shaped connector and toward the first end of the water intake assembly. The axially elongated intake defines a series of openings along the length and about the periphery thereof for allowing water to pass into and be guided by the intake toward the open end of the water intake assembly. A generally cylindrical outlet horizontally projects in a second direction away from the T-shaped connector and toward the open end of the water intake assembly for directing water in the water intake assembly toward an inlet to the storm sewer pipe. A wrapper operably extends along and about the generally cylindrical intake for creating an energy differential between the sediment water flowing into the water intake assembly and the water in the stormwater basin thereby affecting separation of particulate sediment from the water flowing into the sediment water intake assembly. A hollow riser is joined to and extends upwardly from the connector generally normal to the axis extending between the first and second ends of the water intake assembly. A terminal end of the riser vertically extends a predetermined distance below an emergency overflow level of the sediment basin. The hollow riser defines a passage for viewing water quality flowing toward the second end of the water intake assembly.

Preferably, the length of the intake for the water intake assembly is determined by the overall size of the stormwater basin wherein the stormwater pollution management apparatus is to be used. Moreover, the size of the openings defined by the intake of the water intake assembly is determined by the overall size of the stormwater basin wherein the stormwater pollution management apparatus is to be used.

In one form, the wrapper extending along and about the intake for the water intake assembly includes a replaceable wire screen mesh arranged in layered relation relative to a replaceable fabric screen. Preferably, the wire mesh and fabric screen are operably coupled to the intake for the water intake assembly by a series of bands.

In a preferred form, the hollow riser has an open top end and defines a series of openings along the length and about the periphery thereof for allowing water to pass into and be guided by the riser and the outlet toward the second end of the water intake assembly. In one form, the hollow riser further includes a wrapper operably joined to and extending along and thereabout for creating an energy differential between the sediment water flowing into the riser and the water in the stormwater basin thereby affecting separation of particulate sediment from the water flowing into the riser.

In another form, the stormwater pollution management apparatus further includes a manifold having the outlet from a plurality of said sediment water intake assemblies operably connected thereto. In this form, the manifold has an outlet leading to the inlet to the sewer pipe.

According to another aspect, there is provided a method for using a stormwater pollution management apparatus for draining water in a stormwater basin into a storm drain including the steps of: approximating the size of the basin; providing a water intake assembly having a first end and a second end and including an axially elongated and hollow inlet for receiving and directing water toward the storm drain, with the inlet for the water intake assembly defining a plurality of openings, with each opening having a closed margin defined by the inlet, and with the closed margin of the openings defined by the inlet being sized to establish a predetermined water flow through the inlet and toward the storm drain thereby controlling the level of water in the stormwater basin, with the sediment water intake assembly further including a wrapper extending along and about the intake for creating an energy differential between the water flowing into the sediment water intake assembly and the sediment water in the stormwater basin thereby affecting separation of particulate from the water flowing into the sediment water intake assembly; and positioning the water intake assembly such it horizontally extends outwardly from the storm sewer and is supported proximately below an upper surface of the sediment water in the stormwater basin.

Preferably, the method for using a stormwater pollution management apparatus for draining water in a stormwater basin includes the further step of: providing more than one sediment water intake assembly in operable combination with said storm drain. In another form, the sediment water intake is designed to permit viewing of the water flowing therethrough and toward the storm drain.

DETAILED DESCRIPTION OF THE DISCLOSURE

Figure 1:
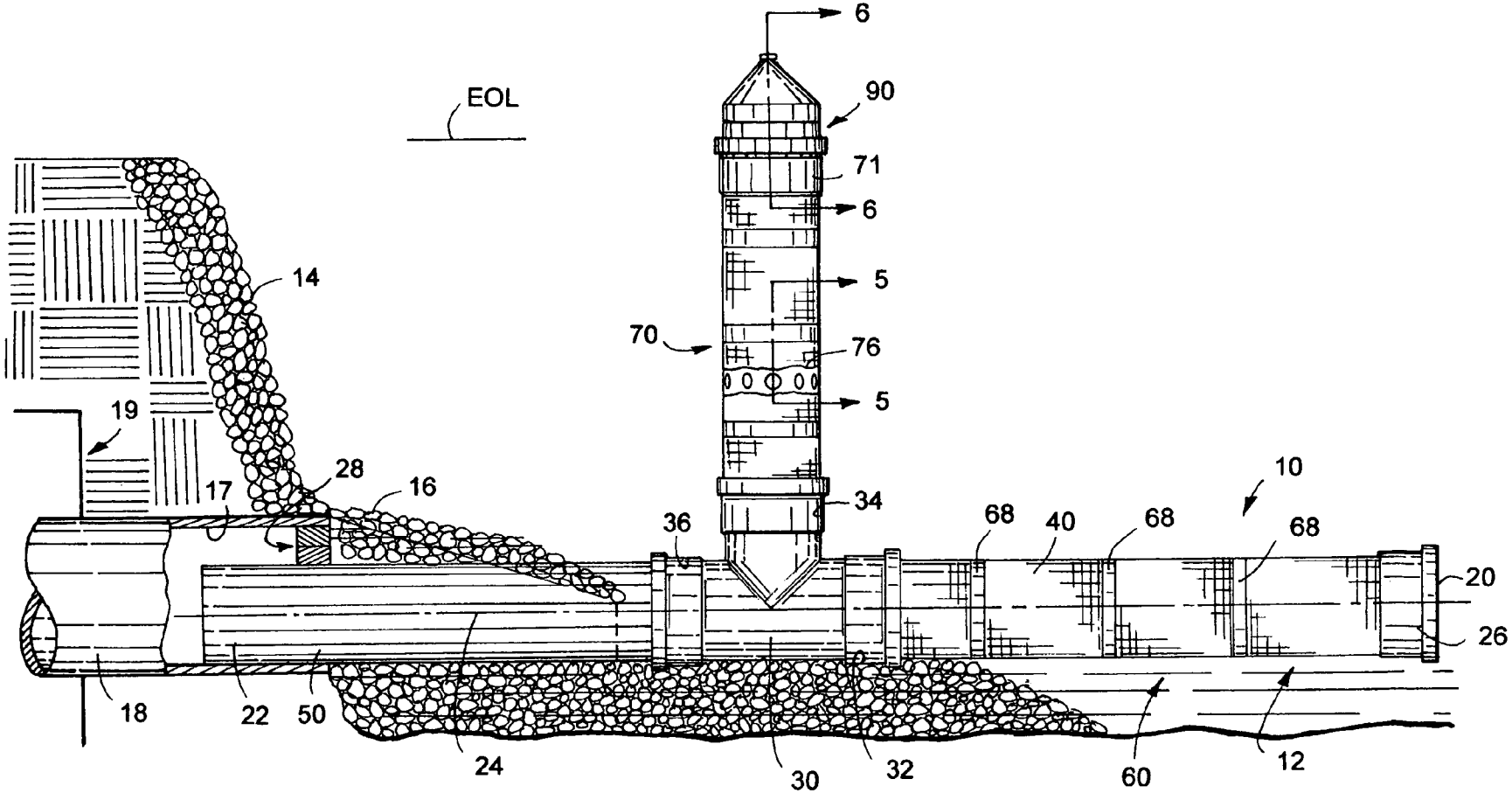
FIG. 1 is a side elevational view of one form of a stormwater pollution management apparatus embodying principals of the present disclosure.

While the present disclosure is susceptible of embodiment in multiple forms, there is shown in the drawings and will hereinafter be described preferred embodiments of the disclosure, with the understanding the present disclosure sets forth embodiments which are not intended to limit the disclosure to the specific embodiments illustrated and described.

Referring now to the drawings, wherein like reference numerals indicate like parts through the several views, FIG. 1 shows a stormwater pollution management apparatus according to the present disclosure and generally identified by reference numeral 10. In one form, the stormwater pollution management apparatus 10 includes a sediment water intake assembly, generally identified by reference numeral 12. As shown in FIG. 1, and during use, the sediment water intake assembly 12 is adapted to be supported proximately at an acceptable upper surface of water in a stormwater basin 14. Gravel 16 (typically #4 stone although other types of stone are contemplated) extends outwardly from an inlet 17 of a sewer pipe or drain 18 for the basin 14 and is used to support the sediment water intake assembly 12.

Figure 2:
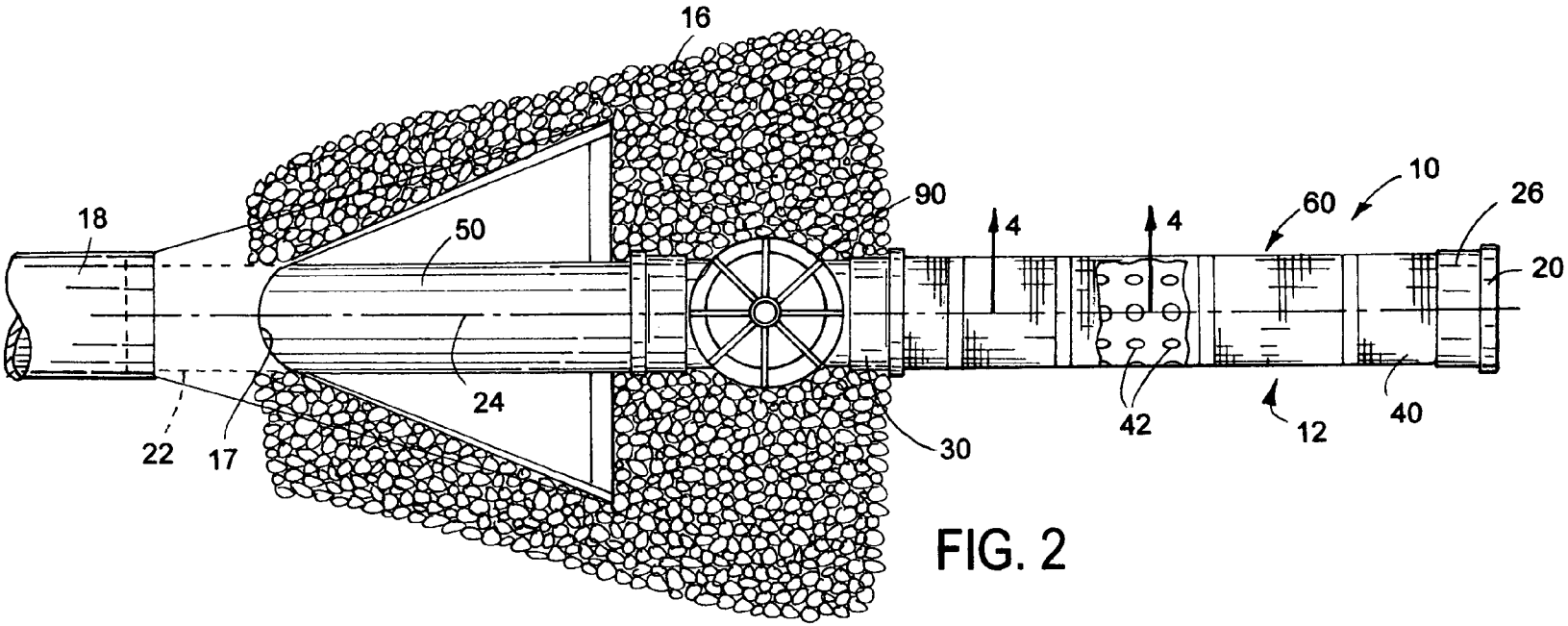
FIG. 2 is a top plan view of the stormwater pollution management apparatus shown in FIG. 1.

As shown in FIGS. 1 and 2, the water intake assembly 12 defines a water flow path leading to inlet 17 of the sewer pipe or drain 18 and has a first distal end 20 and a second proximal end 22. Preferably, the first and seconds ends 20, 22, respectively, of the intake assembly 12 are generally aligned relative to each other along an axis 24. In the illustrated embodiment, the first end 20 of the intake assembly 12 is closed by a cap 26. The proximal end 22 of the intake assembly 12 is arranged in operable combination with and opens to the sewer pipe or drain 18 typically leading to an outlet control structure, generally represented in FIG. 1 by reference numeral 19. As shown in FIG. 1, a conventional brick and mortar joint 28 serves to temporarily maintain the proximal end 22 of the intake assembly 12 in operable combination with the inlet end 17 of the sewer pipe or drain 18 until construction is completed.

As shown in FIG. 1, the water intake assembly 12 includes an inverted T-shaped hollow connector 30, an axially elongated and hollow intake 40, and a hollow outlet 50 all arranged in continuous and contiguous relation relative to each other so that there can be a continuous flow of water from end 20 toward end 22 leading to the inlet 17 to the sewer pipe 18 when required whereby controlling the level of water in the stormwater basin 14. As shown, in FIG. 3, the connector 30 includes three ports 32, 34 and 36. The ports 32, 34 and 36 are preferably interconnected in substantially non-obstructed fluid communication relative to each other.

Figure 3:
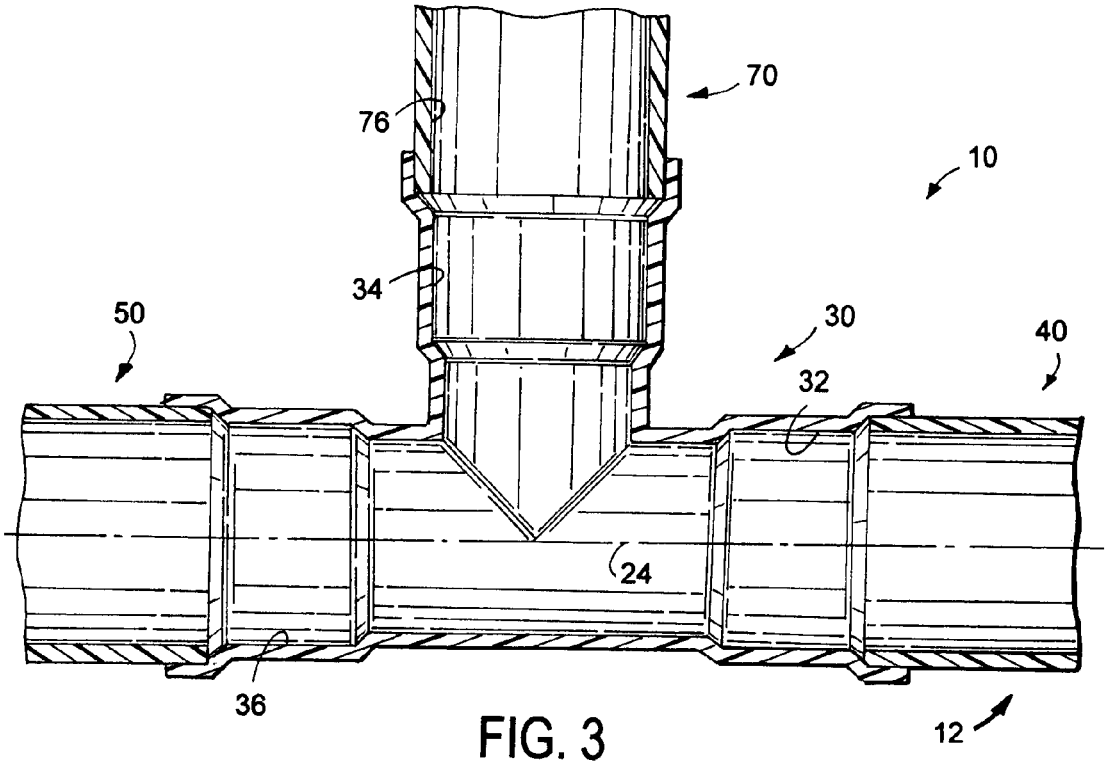
FIG. 3 is an enlarged sectional view of a longitudinal portion of the stormwater pollution management apparatus shown in FIG. 1.

As shown in FIG. 3, the axially elongated intake 40 projects generally horizontally from port 32 and from one side of the connector 30 toward the first end 20 (FIG. 1) of the sediment water intake assembly 12. Outlet 50 likewise has an axially elongated configuration and projects generally horizontally from port 36 and from an opposite side of the connector 30 toward the second end 22 (FIG. 1) of the sediment water intake assembly 12. The connector 30, inlet 40, and outlet 50 of the water intake assembly 12 are each preferably fabricated from conventional plastic or other suitable structural and yet lightweight materials such as HDPE, PE, polypropylene, or PVC to simply the design, facilitate construction, while rendering an efficient and effective water intake assembly which is economical to manufacture.

Preferably, intake 40 of the water intake assembly 12 has a generally cylindrical cross-sectional configuration and a diameter based on the desired dewatering characteristics of a specific assembly. That is, and in a preferred form, the length of the intake 40 for the water intake assembly 12 is determined by the overall size of the stormwater basin 14 wherein the pollution management apparatus of the present disclosure is to be used. Moreover, the diameter of the intake 40 is determined by the diameter of the drain pipe or sewer 18 (FIG. 1). In the illustrated embodiment, the intake 40 for the water intake assembly 12 ranges in diameter between about 4.0 inches to about 24 inches. Preferably, intake 40 has a diameter measuring about 12 inches. Moreover, and because it is formed from the above-described lightweight materials, the operative length of the intake 40 can have a wide range of lengths. That is, the intake 40 for the water intake assembly 12 can range between about 3.5 feet in length to about 8 feet in length. In a preferred embodiment, the intake 40 will measure about 5.0 feet in length.

Figure 4:
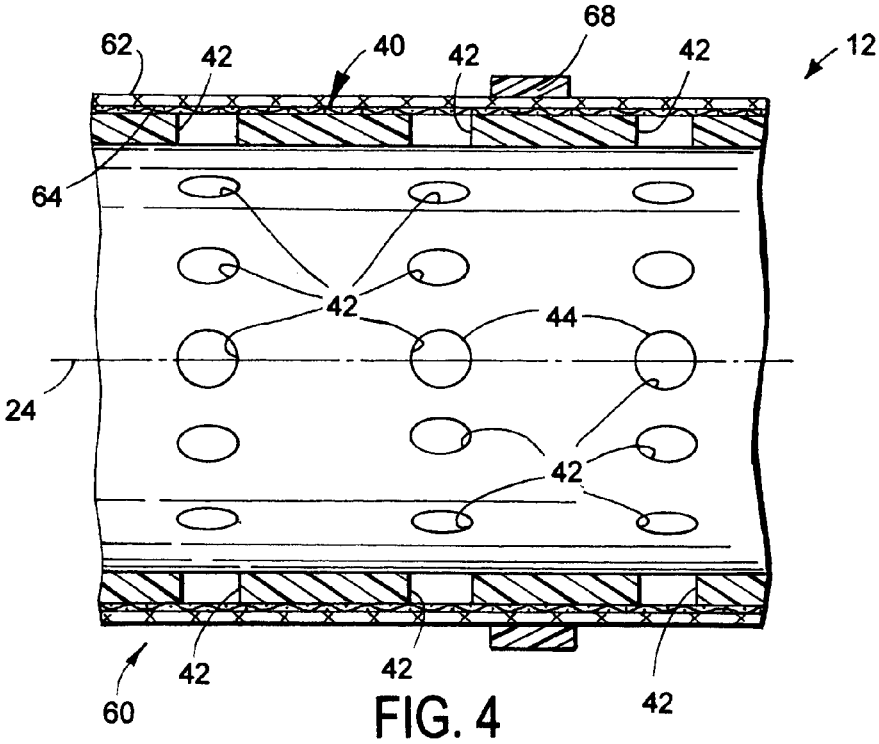
FIG. 4 is an enlarged sectional view taken along line 4-4 of FIG. 2.

As shown in FIG. 4, the intake 40 of the water intake assembly 12 defines a series of holes or openings 42 axially spaced along the length of and radially spaced about the periphery of intake 40. Each hole 42 is preferably defined by a closed margin 44. The holes or openings 42 allow water to flow into the intake 40 from the basin 14 (FIG. 1). Preferably, the size of the openings 42 in the intake 40 to the water intake assembly 12 is determined by the overall size of the basin 14 wherein the pollution management apparatus of the present disclosure is to be used. Suffice it to say, the intake 40 directs the water entering the intake assembly 12 through the holes 42 toward the second outlet end 22 (FIG. 1) of the intake assembly 12 and into the sewer pipe 18. In the illustrated embodiment, the holes or openings 42 have a diameter ranging between about 0.5 inches to about 2.5 inches. In a most preferred form, the holes or openings 42 have a diameter of about 2.0 inches. Moreover, the holes or openings 42 are spaced apart by an axial distance ranging between about 1.25 inches and about 2.5 inches. In a preferred form, the holes or openings 42 are spaced apart by an axial distance of about 2.0 inches.

The outlet 50 directs water received from connector 30 and intake 40 toward the second outlet end 22 of the intake assembly 12 and into the sewer pipe 18. Preferably, the outlet 50 of the water intake assembly 12 has a generally cylindrical cross-sectional configuration and a diameter based on the desired dewatering characteristics of a specific assembly. Generally, the outlet 50 corresponds in diameter to the diameter of the inlet 40. Moreover, and because it is formed from the above-described materials, the operative length of the intake 40 can have a wide range of lengths. That is, the outlet 50 for the water intake assembly 12 can range between about 2.0 feet in length to about 8 feet in length. In a preferred embodiment, the intake 40 will measure about 5 feet in length. Outlet 50, however, is preferably not apertured and, in one form, has a solid cross-sectional configuration along the length thereof.

As shown in FIG. 4, the sediment water intake assembly 12 further includes a perforated sock or wrapper, generally indicated by reference numeral 60, for creating an energy differential between the sediment water flowing into the intake assembly 12 and the water in the stormwater basin 14 thereby affecting separation of particulate sediment from the water flowing into the intake assembly 12. Depending upon the size of sediment particulate, the sock or wrapper 60 can also provide a filtering effect to the water passing therethrough.

Preferably, wrapper 60 is configured for replacement as required or desired with another wrapper of similar design such that the water intake assembly 12 maintains the desired water level in the stormwater basin 14.

Wrapper 60 is operably joined to and is designed to fit along and about the intake 40 to the sediment water intake assembly 12. In one form, wrapper 60 includes a wire screen mesh material 62. In a preferred form, a conventional 0.25 inch welded wire mesh material forms part of the wrapper 60. Alternatively, the wrapper 60 extending along and about the intake 40 to the sediment water intake assembly 12 includes the wire mesh material 62 arranged in layered relation relative to a fabric screen 64 which also extends along and about the intake 40 to the sediment water intake assembly 12. In one form, the fabric screen 64 is preferably a woven polypropylene fabric having a 10% to 20% open area and is commonly sold under the tradename Wev-tec 403. When a fabric screen 64 and wire mesh material 62 are arranged in layered relation to form the wrapper 60, the wire mesh material 62 is preferably arranged in surrounding relation relative to the fabric screen 64. As will be appreciated, however, the layered order of wire mesh 62 and woven fabric 64 can easily and readily be reversed without detracting or departing from the novel spirit and scope of the present development.

A series of clamps or securement bands 68 serve to releasably maintain the wrapper 60 in place along and about the intake 40 to the water intake assembly 12. As such, the securement clamps 68 can be cut or otherwise released to effect replacement of the wrapper 60 about and along the length of the intake 40 to the water intake assembly 12 as required or desired and such that the water intake assembly 12 maintains the desired water level in the basin 14.

Returning to FIG. 1, the water intake assembly 12 further includes a hollow riser 70 extending rigidly and upwardly from the connector 30 and, in one form, generally normal to the axis 24 extending between the opposed ends 20, 22 of the intake assembly 12. As shown in FIG. 1, the hollow riser 70 extends away from the connector 30 for a predetermined distance and such that a distal end 71 of the hollow riser 70 terminates below an emergency overflow level of the basin 14 represented in FIG. 1 by EOL.

As shown in FIG. 3, the hollow riser 70 extends generally vertically from port 34 of the connector 30 and as an elongated open-top configuration. As shown in FIG. 3, the hollow riser 70 defines a passage 76 opening to distal end 71 (FIG. 1) of riser 70 and to the port 34 of connector 30 for viewing the water quality flowing in the sediment water intake assembly 12 toward the inlet 17 to the sewer pipe or drain 18. Riser 70 is preferably fabricated from conventional plastic or other suitable structural and yet lightweight materials such as HDPE, PE, polypropylene, or PVC to simply the design, facilitate construction, while rendering an efficient and effective means of viewing the water quality flowing in the sediment water intake assembly 12 toward the inlet 17 to the sewer pipe or drain 18 and which remains economical.

Figure 5:
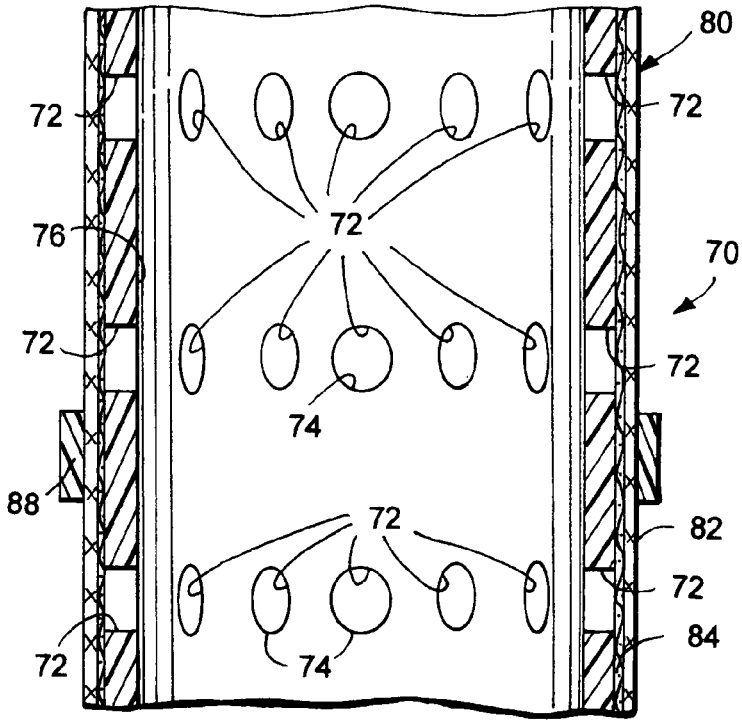
FIG. 5 is an enlarged sectional view taken along line 5-5 of FIG. 1.

In the illustrated embodiment, riser 70 has a generally cylindrical cross-sectional configuration. As shown in FIG. 5, riser 70 defines a series of holes or openings 72 axially spaced along the length of and radially spaced about the periphery of riser 70. Each hole 72 is preferably defined by a closed margin 74. The holes or openings 72 allow water which rises sufficiently above the water intake assembly 12 to flow into the riser 70 from the basin 14 (FIG. 1). Thereafter, the riser 70 cooperates with connector 30 and outlet 50 (FIG. 1) to direct the water entering the riser 70 through the holes 72 toward the second outlet end 22 of the intake assembly 12 and into the sewer pipe 18. In the illustrated embodiment, the holes 72 have a diameter ranging between about 0.5 to about 2.5 inches. In a most preferred form, the openings 72 have a diameter of about 2.0 inches. Moreover, the holes or openings 72 are spaced apart by an axial distance ranging between about 1.25 inches and about 2.5 inches. In a preferred form, the holes or openings 72 are spaced apart by an axial distance of about 2.0 inches.

As shown in FIG. 5, riser 70 also includes a perforated sock or wrapper, generally indicated by reference numeral 80, for creating an energy differential between the sediment water flowing into the riser 70 through holes 72 and the water in the stormwater basin 14 (FIG. 1) thereby effecting separation of particulate sediment from the water flowing through the sediment water intake assembly toward the sewer pipe or drain 18 (FIG. 1). Depending upon the size of sediment particulate, the sock or wrapper 80 can also provide a filtering effect to the water passing therethrough. Preferably, the wrapper 80 is configured for replacement as required or desired with another wrapper of similar design.

Wrapper 80 is operably joined and is designed to fit along and about riser 70. In one form, wrapper 80 includes a wire screen mesh material 82. A conventional 0.25 inch welded wire mesh material preferably forms part of the wrapper 80. Alternatively, the wrapper 80 can include the wire mesh material 82 arranged in layered relation relative to a fabric screen 84 which also extends along and about the riser 70. In one form, the fabric screen 84 is preferably a woven polypropylene fabric having a 10% to 20% open area and is sold under the tradename Wev-tec 403. When a fabric screen 84 and wire mesh material 82 are arranged in layered relation to form wrapper 80, the wire mesh material 82 is preferably arranged in surrounding relation relative to the fabric screen 84. As will be appreciated, however, the layered order of mesh 82 and fabric 84 can easily and readily be reversed without detracting or departing from the novel spirit and scope of the present disclosure.

A series of removable clamps or securement bands 88 serve to releasably maintain the wrapper 80 in place along and about riser 70. The securement clamps 88 can be cut or otherwise released to effect replacement of the wrapper 80 about and along the length of the riser 70.

Figure 6:
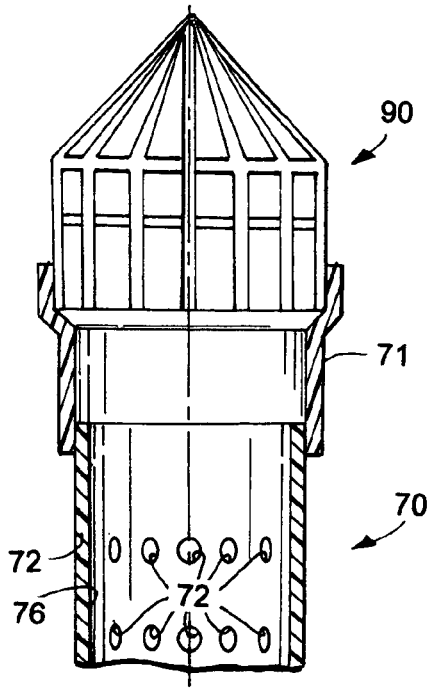
FIG. 6 is an enlarged sectional view taken along line 6-6 of FIG. 1.

As shown in FIG. 6, the open distal end 71 of riser 70 is preferably provided with a trash filter 90. In the illustrated embodiment, the trash filter 90 is friction fit in the open end 71 of riser 70 to allow removal of the filter 90 from riser 70 whereby facilitating inspection of the water flowing through the intake assembly 12 to the inlet 17 to the sewer pipe or drain 18 (FIG. 1). In the illustrated embodiment, filter 90 has a design for inhibiting trash and debris from inadvertently entering or being introduced into the water intake assembly 12 through riser 70.

Depending upon the material used to form the components of apparatus 10, the methodology and means used for operably securing the connector 30, intake 40, outlet 50, and riser 70 in operable combination can take a variety of designs and forms without detracting or departing from the spirit and novel concept of the present disclosure. For example, a conventional chemical compound, adhesive or glue can be used to operably secure the components of apparatus 10 in operable combination with each other. Alternatively, suitable clamps or other properly arranged mechanical devices can be used to operably secure the components of apparatus 10 in operable combination with each other.

In another form, each port 32, 34, and 36 of the connector 30 is provided with suitable seal structure 92 (FIG. 7) for operably holding and maintaining the connector 30, inlet 40, outlet 50 and riser 70 in operable combination relative to each other. Preferably, the seal structure 92 is arranged toward a distal end of each port 32, 34, and 36 on the connector 30. Since the seal structure 92 arranged toward a distal end of each port 32, 34, and 36 on the connector 30 is substantially similar, a detailed description of the seal structure 92 arranged between inlet 40 and adjacent to the distal end of connector port 32 will be discussed in detail.

Figure 7:
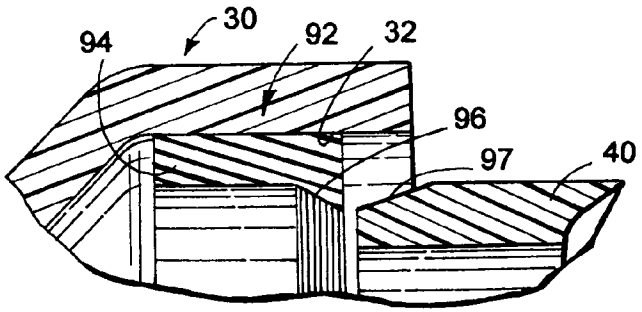
FIG. 7 is an enlarged sectional view showing components of the stormwater pollution management apparatus is an unassembled state relative to each other.

As shown in FIG. 7, seal structure 92 includes an annular and resilient elastomer seal 94 carried and secured toward a distal end of connector port 32. As shown, the annular seal 94 includes an annular ridge or lip 96 extending radially inwardly toward axis 24 (FIG. 3) of the water intake assembly 12. Moreover, that end of the intake 40 adapted to be axially inserted into operable combination with the connector 30 has a suitably configured annular bevel or chamfer 97 extending about the distal end thereof. Suffice it to say, when intake 40 is axially inserted into connector port 32, the annular lip or ridge 96 on seal 94 and the bevel or chamfer 97 on the intake 40 coact to allow the distal end of inlet 40 to axially move past the lip 96. Thereafter, however, the seal structure 92 serves to maintain the connector 30 and intake 40 in operable combination and inhibits debris and sediment particulate from entering the conjuncture between the conjoined components 30, 40, 50 and 70 of the pollution management apparatus 10.

Figure 8:
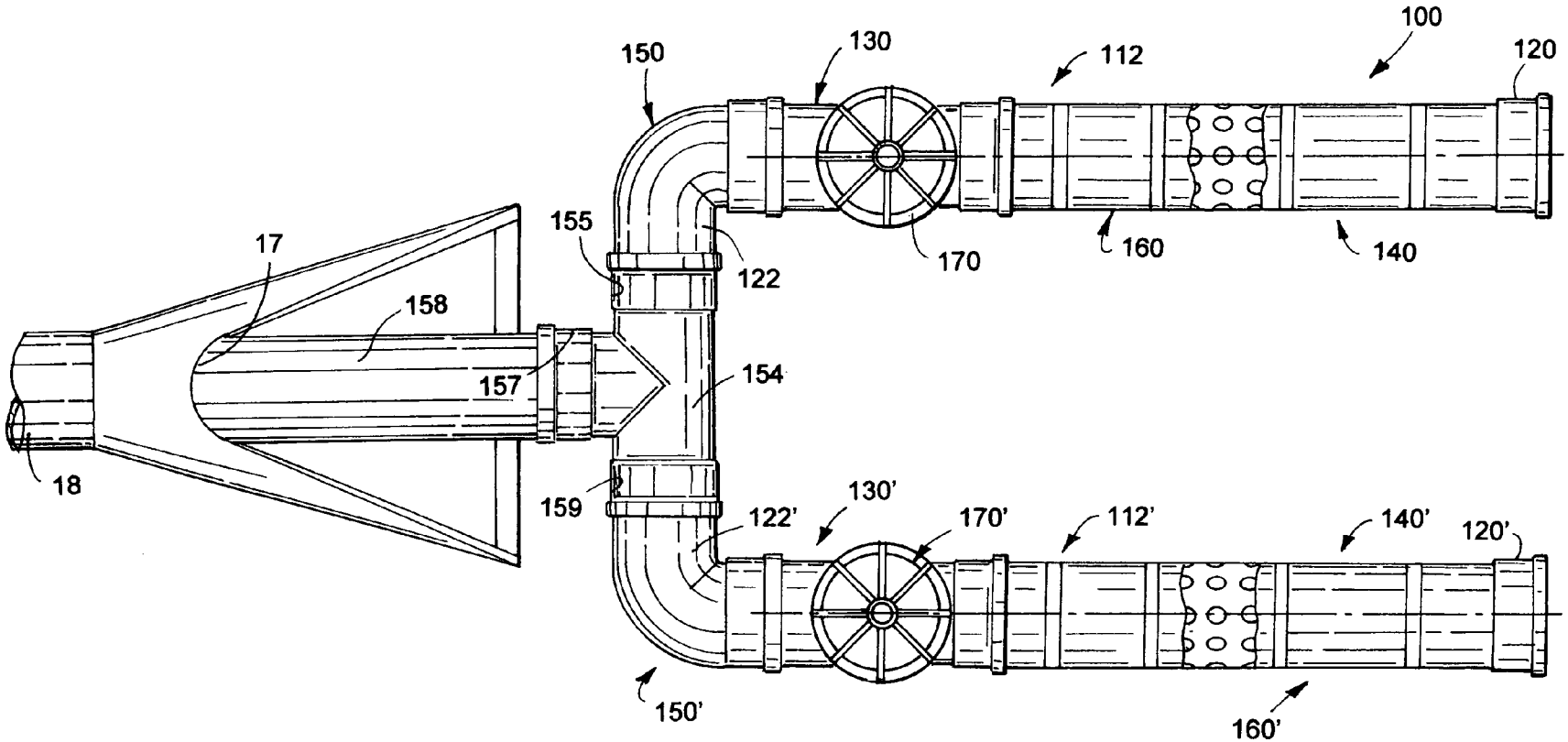
FIG. 8 is a top plan view of an alternative form of a stormwater pollution management apparatus embodying principals of the present disclosure.

FIG. 8 illustrates an alternative form of a stormwater pollution management apparatus according to the present disclosure. This alternative form of stormwater pollution management apparatus is designated generally by reference numeral 100. The elements of this alternative stormwater pollution management apparatus that are functionally analogous to those components or elements discussed above regarding the stormwater pollution management apparatus 10 are designated by reference numerals identical to those listed above with the exception this embodiment uses reference numerals in the 100 series.

In the alternative form illustrated in FIG. 8, the stormwater pollution management apparatus 100 includes a plurality of water intake assemblies 112 and 112' operably connected to a common manifold 154 and adapted to be supported proximately at an acceptable upper surface of water in a stormwater basin 14 (FIG. 1). The water intake assemblies 112 and 112' are substantially similar to the sediment water intake assembly 12 discussed in detail above. Suffice it to say, each sediment water intake assembly 112, 112' includes a connector 130, 130', an intake 140, 140', and an outlet 150, 150', respectively, connected in operable combination relative to each other. The connectors 130, 130', intakes 140, 140', and outlets 150, 150' of the water intake assemblies 112, 112', respectively, are all arranged in contiguous and continuous relation relative to each other so there can be a continuous flow of water from ends 120, 120' toward ends 122, 122', respectively, leading to the manifold 154 and, ultimately, to the inlet 17 to the drain or sewer pipe 18 when required whereby controlling the level of water in basin 14 (FIG. 1). The inlet 140, 140' of each sediment water intake assembly 112, 112' is provided with a sock or wrapper 160, 160', respectively, for creating an energy differential between the sediment water flowing into the respective intake assembly and the water in the basin 14 (FIG. 1) thereby affecting separation of particulate sediment from the water flowing into the respective intake assembly 112, 112'. As discussed above, and depending upon the size of sediment particulate, each sock or wrapper 160, 160' can also provide a filtering effect to the water passing therethrough.

Moreover, each sediment water intake assembly 112, 112' includes a hollow and apertured riser 170, 170' extending upwardly from and joined to the connector 130, 130' of the respective water intake assembly 112, 112'. The hollow and apertured riser 170, 170' extends away from the respective connector 130, 130' for a predetermined distance and such that a distal end of each hollow riser 170, 170' terminates below an emergency overflow level of the stormwater basin 14 represented in FIG. 1 by EOL.

Like riser 70 discussed above, each riser 170, 170' is provided with a replaceable perforated sock or wrapper similar to sock 80 discussed above. The wrapper releasably secured about each riser 170, 170' creates an energy differential between the sediment water flowing into the apertured riser 170, 170' and the water in the stormwater basin 14 (FIG. 1) thereby effecting separation of particulate sediment thereby cleansing the water flowing through the sediment water intake assembly toward the sewer pipe or drain 18 (FIG. 1). Depending upon the size of sediment particulate, the sock or wrapper arranged about each riser 170, 170' can also provide a filtering effect to the water passing therethrough. Preferably, each riser 170, 170' is provided with a trash filter 190, 190, respectively, for inhibiting trash and debris from inadvertently entering or being introduced into the water intake assembly 112, 112' while readily allowing a view of the water flowing through each intake assembly 112, 112'.

As shown in FIG. 8, the manifold 154 includes a plurality of ports 155, 157 and 159 which, preferably, are all interconnected in substantially non-obstructed fluid communication relative to each other. As shown, the outlet 150 of water intake assembly 112 operably connects to and extends from port 155 of manifold 154. Similarly, the outlet 150' of water intake assembly 112' operably connects to and extends from port 159 of manifold 154. Moreover, port 157 of manifold 154 is operably connected to a discharge pipe 158. The discharge pipe 158 directs water received from manifold 154 and both water intake assemblies 112, 112' toward and into the sewer pipe 18. As discussed above, a conventional brick and mortar joint 28 (FIG. 1) serves to temporarily maintain a proximal end of the discharge pipe 158 in operable combination with the inlet end 17 of the sewer pipe or drain 18 until construction is completed.

The discharge pipe 158 and manifold 154 are each preferably fabricated from conventional plastic or other suitable structural and yet lightweight materials such as HDPE, PE, polypropylene, or PVC to simply the design, facilitate construction, while rendering an efficient and effective assembly which is economical to manufacture. Although only two water intake assemblies 112, 112' are illustrated in FIG. 8, it will be readily appreciated that more than two water intake assemblies can be joined to a suitably configured manifold if required or desired without detracting or departing from the novel spirit and scope of the present disclosure.

According to another aspect, there is provided a method for managing stormwater pollution drainage from a stormwater basin 14 and into a storm drain 18 including the steps of: approximating the size of the basin 14; providing a sediment water intake assembly 12 having a first end 20 and a second end 22 and including an axially elongated and hollow inlet 40 for receiving and directing water toward the storm drain 18, with the inlet 40 for the water intake assembly 12 defining a plurality of openings 42, with each opening 42 having a closed margin defined by the inlet 40, and with the closed margin of the openings 42 defined by the inlet 40 being sized to establish a predetermined water flow through the inlet 40 and toward the storm drain 18 thereby controlling the level of water in the basin 14, with the sediment water intake assembly 12 further including a wrapper 70 extending along and about the intake 40 for creating an energy differential between the water flowing into the water intake assembly and the sediment water in the basin 14 thereby affecting separation of particulate from the water flowing into the water intake assembly 12; and positioning the water intake assembly 12 such it horizontally extends outwardly from the storm sewer 18 and is supported proximately at an upper surface of the sediment water in basin 14.

Preferably, the method for managing stormwater pollution drainage from a stormwater basin 14 includes the further step of: determining the discharge pipe size at an outlet control structure 19 of the basin 14. Moreover, the method for managing stormwater pollution drainage from a stormwater basin can include the further step of: providing more than one sediment water intake assembly 112, 112' in operable combination with the storm drain 18. In another form, the sediment water intake 12 is designed to permit viewing of the water flowing therethrough and toward the storm drain 18.

The stormwater pollution management apparatus according to the present disclosure provides an efficient and cost effective apparatus for the dissipation of stormwater runoff collected in a stormwater basin. From the above, it will be appreciated that the stormwater level in substantially any size basin can be controlled through use of a stormwater pollution control or management apparatus according to the present disclosure. Because of the positional relation between the open ended design of the riser on the water intake system and the emergency overflow level of the basin, the stormwater pollution management apparatus is able to control water flow from the basin even under peak flow conditions. Moreover, the stormwater pollution management apparatus according to the present disclosure provides a system wherein sediment particulate is separated from the water flowing into the sewer pipe this eliminating some—if not all—of the problems mentioned above.

From the foregoing, it will be observed that numerous modifications and variations can be made and effected without departing or detracting from the true spirit and novel concept of the present disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A stormwater pollution management apparatus adapted to be arranged in operable combination with a storm sewer pipe, said stormwater pollution management apparatus comprising:

a sediment water intake assembly adapted to be supported proximately at an upper surface of water in a stormwater basin, said sediment water intake assembly having a first end and an second end generally aligned along an axis and includes a hollow inverted T-shaped connector, an axially elongated and generally horizontal intake projecting in a first direction from one side of said T-shaped connector and toward the first end of said water intake assembly, with said axially elongated intake defining a series of openings along the length and about the periphery thereof for allowing water to pass into and be guided by the intake toward the second end of said water intake assembly, with said water intake assembly further including a generally horizontal outlet projecting in a second direction from a second side of said T-shaped connector and toward the second end of said water intake assembly for directing water in said water intake assembly toward an inlet to the storm sewer pipe, and wherein said water intake assembly further includes a wrapper operably joined to and extending along and about said generally horizontal intake for creating an energy differential between the sediment water flowing into the water intake assembly and the water in said basin thereby affecting separation of particulate sediment from the water flowing into the water intake assembly; and a hollow riser extending upwardly from said connector and generally normal to said axis, with a terminal end of said riser extending a predetermined distance below an emergency overflow level of said basin, and with said hollow riser defining a passage for viewing water quality flowing toward the second end of said sediment water intake assembly.

2. The stormwater pollution management apparatus according to claim 1, wherein the connector, the intake, and the outlet of said water intake assembly are each formed from plastic.

3. The stormwater pollution management apparatus according to claim 1, wherein the length of said intake is determined by the overall size of the stormwater basin wherein said stormwater pollution management apparatus is to be used.

4. The stormwater pollution management apparatus according to claim 1, wherein the size of the openings defined by said intake is determined by the overall size of the stormwater basin wherein said stormwater pollution management apparatus is to be used.

5. The stormwater pollution management apparatus according to claim 1, wherein the wrapper extending along and about said generally horizontal intake includes a wire screen mesh operably coupled to the intake by a series of bands.

6. The stormwater pollution management apparatus according to claim 1, wherein the wrapper extending along and about said generally horizontal intake is modular and is replaceable.

7. The stormwater pollution management apparatus according to claim 1, wherein the wrapper extending along and about said generally horizontal intake includes a wire screen mesh arranged in layered relation relative to a fabric screen, with said wire mesh and fabric screen being operably coupled to the intake by a series of bands.

8. The stormwater pollution management apparatus according to claim 7, wherein the wire screen mesh and fabric screen are each replaceable.

9. The stormwater pollution management apparatus according to claim 1, wherein said hollow riser has an open top end and defines a series of openings along the length and about the periphery thereof for allowing water to pass into and be guided by said riser and said outlet toward the second end of said water intake assembly.

10. The stormwater pollution management apparatus according to claim 9, wherein said hollow riser further includes a wrapper operably joined to and extending along and about said riser for creating an energy differential between the sediment water flowing into said riser and the water in said stormwater basin thereby affecting separation of particulate sediment from the water flowing into said riser.

11. A stormwater pollution management apparatus adapted to be arranged in operable combination with a storm sewer pipe, said stormwater pollution management apparatus comprising:

a sediment water intake assembly adapted to be supported proximately at an upper surface of water in a stormwater basin, said sediment water intake assembly having a first end and an second open end generally aligned along an axis and includes a hollow inverted T-shaped connector, an axially elongated and generally cylindrical intake connected to and horizontally projecting away from said T-shaped connector and toward the first end of said sediment water intake assembly, with said axially elongated intake defining a series of openings along the length and about the periphery thereof for allowing water to pass into and be guided by the intake toward the second end of said water intake assembly, with said water intake assembly further including a generally cylindrical outlet horizontally projecting in a second direction away from said T-shaped connector and toward the second end of said water intake assembly for directing water in said water intake assembly toward an inlet to the storm sewer pipe, and wherein said water intake assembly further includes a wrapper operably extending along and about said generally cylindrical intake for creating an energy differential between the sediment water flowing into the water intake assembly and the water in said basin thereby affecting separation of particulate sediment from the water flowing into the water intake assembly; and a hollow riser extending upwardly from said connector and generally normal to said axis, with a terminal end of said riser extending a predetermined distance below an emergency overflow level of said stormwater basin, and with said hollow riser defining a passage for viewing water quality flowing toward the second end of said water intake assembly.

12. The stormwater pollution management apparatus according to claim 11, wherein the length of said intake is determined by the overall size of the stormwater basin wherein said stormwater pollution management apparatus is to be used.

13. The stormwater pollution management apparatus according to claim 11, wherein the size of the openings defined by said intake is determined by the overall size of the stormwater basin wherein said stormwater pollution management apparatus is to be used.

14. The stormwater pollution management apparatus according to claim 11, wherein the wrapper extending along and about said intake includes a replaceable wire screen mesh arranged in layered relation relative to a replaceable fabric screen, with said wire mesh and fabric screen being operably coupled to the intake by a series of bands.

15. The stormwater pollution management apparatus according to claim 11, wherein said hollow riser has an open top end and defines a series of openings along the length and about the periphery thereof for allowing water to pass into and be guided by the said riser and said outlet toward the second end of said water intake assembly.

16. The stormwater pollution management apparatus according to claim 15, wherein said hollow riser further includes a wrapper operably joined to and extending along and about said riser for creating an energy differential between the sediment water flowing into said riser and the water in said stormwater basin thereby affecting separation of particulate sediment from the water flowing into said riser.

17. The stormwater pollution management apparatus according to claim 15, further including manifold having an outlet of a plurality of said water intake assemblies operably connected thereto, and with said manifold having an outlet leading to the inlet to said sewer pipe.

18. A method for managing stormwater pollution drainage from a sediment/detention basin into a storm drain comprising the steps of:

approximating the size of the stormwater basin;

providing a sediment water intake assembly having first and second ends and including an axially elongated and hollow inlet for receiving and directing water toward said storm drain, with said inlet defining a plurality of openings, with each opening having a closed margin defined by said inlet, and with the size of the closed margin of the openings defined by said inlet being calculated to establish a predetermined water flow through said inlet and toward said storm drain thereby controlling the level of water in the stormwater basin, with said sediment water intake assembly further including a wrapper extending along and about said intake for creating an energy differential between the water flowing into the sediment water intake assembly and the sediment water in said basin thereby affecting separation of particulate sediment from the water flowing into the water intake assembly;

connecting said water intake assembly to a first side of an inverted T-shaped connector;

connecting a second side of said T-shaped connector to said storm drain;

connecting a hollow riser to extend upwardly from said T-shaped connector; and positioning said water intake assembly such it horizontally extends outwardly from said storm drain and is supported proximately at an upper surface of the stormwater water in said basin, with said riser extending a predetermined distance below an emergency overflow level of said basin.

19. The method for managing stormwater pollution drainage from a sediment/detention basin into a storm drain according to claim 18, including the further step of: providing more than one sediment water intake assembly in operable combination with said storm drain.

20. The method for managing stormwater pollution drainage from a sediment/detention basin into a storm drain according to claim 18, wherein said hollow riser is designed to permit viewing of the water flowing the sediment water intake 00 and toward the storm drain.

* * * * *